US010072680B2

(12) United States Patent
Hahn et al.

(10) Patent No.: US 10,072,680 B2
(45) Date of Patent: Sep. 11, 2018

(54) APPARATUS FOR THE ENERGY-OPTIMIZED HYDRAULIC CONTROL OF AT LEAST ONE DOUBLE-ACTION WORKING CYLINDER

(71) Applicant: Liebherr-Mining Equipment Colmar SAS, Colmar (FR)

(72) Inventors: Philipp Hahn, Turckheim (FR); Volker Gliniorz, Breisach am Rhein (DE); Guillaume Bonnetot, Zimmersheim (FR)

(73) Assignee: Liebherr-Mining Equipment Colmar SAS, Colmar (FR)

( * ) Notice: Subject to any disclaimer, the term of this patent is extended or adjusted under 35 U.S.C. 154(b) by 189 days.

(21) Appl. No.: 15/147,094

(22) Filed: May 5, 2016

(65) Prior Publication Data

US 2017/0023025 A1 Jan. 26, 2017

(30) Foreign Application Priority Data

May 7, 2015 (DE) ..... 10 2015 005 920

(51) Int. Cl.
*F15B 11/08* (2006.01)
*B66C 13/20* (2006.01)
(Continued)

(52) U.S. Cl.
CPC ..... *F15B 11/08* (2013.01); *B66C 13/12* (2013.01); *B66C 13/20* (2013.01); *E02F 9/2217* (2013.01); *E02F 9/2271* (2013.01); *F15B 1/04* (2013.01); *F15B 13/0401* (2013.01); *F15B 21/14* (2013.01); *F15B 1/027* (2013.01); *F15B 3/00* (2013.01); *F15B 2211/212* (2013.01); *F15B 2211/214* (2013.01); *F15B 2211/3058* (2013.01); *F15B 2211/7053* (2013.01); *F15B 2211/761* (2013.01); *F15B 2211/88* (2013.01)

(58) Field of Classification Search
CPC .. F15B 1/024; F15B 1/027; F15B 3/00; F15B 11/08; F15B 21/14
See application file for complete search history.

(56) References Cited

U.S. PATENT DOCUMENTS 5,058,384 A * 10/1991 Dunwoody ..... B60G 17/0152 60/413
8,286,426 B2 * 10/2012 Bishop ..... F15B 3/00 60/413

FOREIGN PATENT DOCUMENTS

DE 28 30 770 A1 1/1980
DE 10 2014 005 352 A1 10/2015
EP 2 295 171 A1 3/2011

* cited by examiner

*Primary Examiner* — Michael Leslie
(74) *Attorney, Agent, or Firm* — Dilworth & Barrese, LLP

(57) ABSTRACT

The invention relates to an apparatus for the energy-optimized hydraulic control of at least one double-action working cylinder of a work machine comprising a hydraulic pressure transducer which is hydraulically connected to a first piston surface of the working cylinder, to a second piston surface of the working cylinder and to at least one pressure accumulator, wherein the pressure transducer is configured such that the hydraulic energy of a high-pressure volume flow conveyed by the first piston surface to the pressure transducer can be stored completely or at least partially by the at least one connected pressure accumulator and such that the cylinder chamber of the second piston surface of the working cylinder can be filled with a low-pressure volume flow by the pressure transducer.

15 Claims, 2 Drawing Sheets

(51) Int. Cl.

| | |
|---|---|
| ***F15B 21/14*** | (2006.01) |
| ***E02F 9/22*** | (2006.01) |
| ***B66C 13/12*** | (2006.01) |
| ***F15B 1/04*** | (2006.01) |
| ***F15B 13/04*** | (2006.01) |
| *F15B 1/027* | (2006.01) |
| *F15B 3/00* | (2006.01) |

APPARATUS FOR THE ENERGY-OPTIMIZED HYDRAULIC CONTROL OF AT LEAST ONE DOUBLE-ACTION WORKING CYLINDER

BACKGROUND OF THE INVENTION

The invention relates to an apparatus for the energy-optimized hydraulic control of at least one double-action working cylinder of a work machine.

In work machines, working cylinders serve the actuation of any accessory equipment or for the luffing movement of boom systems. The stroke movement as a rule takes place against the load; the retraction of the piston rod, in contrast, is effected unpressurized by the load. In known interconnections of working cylinders in mobile work machines, the retraction of the piston rod is implemented with a pushing load by a restriction control to brake the inward movement speed. On the restriction, the potential energy of the pressurized volume flow displaced by the load on the cylinder is converted into heat. The potential energy present is not only destroyed; cooling power must rather additionally be applied for the heat dissipation within the machine.

A common embodiment of the hydraulic working cylinder in mobile cylinders is the differential cylinder. If the latter is retracted by means of a restriction control and a pressing load, it must be ensured that a refilling of the rod-side cylinder chamber is guaranteed. This is possible, on the one hand, by the switching on of a corresponding supply volume flow through the work pumps; on the other hand, a corresponding refilling of the rod-side cylinder chambers can be carried out by a return of the restricted volume flow. Due to the return of the restricted volume flow, a division thereof is made corresponding to the area ratio of the hydraulic cylinders. In this respect, one portion flows into the rod-side chambers of the cylinders; the other portion is led into the tank.

It is desirable on the storage of the potential energy to acquire as much displaced oil volume as possible with a pressure which is as high as possible. Based on the common interconnection with a return of a partial quantity into the rod-side chambers of the hydraulic cylinders, only a partial quantity of the displaced oil volume is available for storage. The returned partial quantity is additionally restricted, based on the restriction control, from a high pressure level to a low pressure level. Three disadvantages therefore result: The quantity of oil is split; some of the energy is destroyed by the restriction control; and the heat loss additionally has to be led off from the cooling system of the machine.

SUMMARY OF THE INVENTION

It is the aim of this invention to overcome the above-described disadvantages and to provide an energy-optimized operation of one or more working cylinders of a mobile work machine.

This object is achieved by an apparatus in accordance with the features herein. Advantageous embodiments of the apparatus are the subject of the description herein.

In accordance with the description, an apparatus is proposed for the energy-optimized hydraulic control of at least one double-acting working cylinder of a work machine having a hydraulic pressure transducer. The pressure transducer is connected to a first piston surface of the working cylinder and to a second piston surface of the working cylinder, i.e. with a differential cylinder to the piston chamber, on the one hand, and to the ring chamber, on the other hand.

A pressure accumulator is furthermore hydraulically connected to the pressure transducer. The embodiment of the pressure transducer and its interconnection to the working cylinder and to the pressure accumulator is designed such that the hydraulic energy of a high-pressure volume flow conveyed from the first piston surface of the working cylinder to the pressure transducer can be completely or partially compensated by the at least one connected pressure accumulator or can be stored by it. Furthermore, the volume flow picked up at the low-pressure side of the pressure transducer is led to the cylinder chamber of the second piston surface of the working cylinder, whereby said cylinder chamber is refilled with hydraulic medium during the piston movement. The ring chamber is in particular supplied with the required hydraulic volume with a working cylinder in the form of a differential cylinder.

The hydraulic design of the apparatus is therefore characterized in that, in addition to the almost loss-free pressure transduction from a incoming high-pressure level to a low-pressure level for the refilling of the volume-increasing cylinder chamber of the working cylinder, the complete or at least partial storage of the potential energy released by the movement of the working cylinder can also simultaneously be achieved. For example, the refilling of the volume-increasing cylinder chamber of the working cylinder takes place in that the pressure transducer displaces the hydraulic medium required for this purpose and conveys it to the working cylinder. This displacement takes place at a low-pressure level since the high-pressure level of the incoming volume flow of the working cylinder is compensated by the hydraulic accumulator.

The apparatus can be used for controlling a single working cylinder or a plurality of working cylinders. For example, the working cylinders are interconnected in parallel as in a parallel arrangement of two lifting cylinders at the boom.

A possible design of the pressure transducer can comprise a primary cylinder and a secondary cylinder which are coupled to one another via their piston rods. The use of two double-action cylinders as the primary cylinder and secondary cylinder is conceivable in this connection, preferably two differential cylinders coupled via their piston rods. Alternatively, the pressure transducer can comprise a double-action cylinder, for example a differential cylinder or a tandem cylinder as well as a single-action cylinder, in particular a plunger cylinder, as the primary cylinder and secondary cylinder.

In accordance with an advantageous embodiment, the first piston surface of the working cylinder is connected to a piston surface of the primary cylinder so that this piston surface of the primary cylinder is acted on by high pressure. The pressure accumulator can be connected to a cylinder chamber of the primary cylinder or secondary cylinder. The only requirement is that said cylinder chamber acts against the piston surface of the primary cylinder acted on by high pressure. It is ensured by this kind of interconnection that the high pressure output by the working cylinder into the pressure transducer can be very largely compensated or stored by the pressure accumulator. The pressure accumulator can additionally selectively be charged at a higher or lower pressure than the applied high-pressure level of the working cylinder by a suitable choice of the ratio of the two piston surfaces.

With a pressure transducer having two coupled differential cylinders, the high-pressure outlet of the working cylinder can be connected to the ring chamber of the primary cylinder and the high-pressure accumulator can be connected either to the piston chamber of the primary cylinder or to the piston chamber of the secondary cylinder. In an embodiment variant of the pressure transducer with a differential cylinder and a plunger cylinder, there is the possibility of connecting the high-pressure outlet of the working cylinder to the piston chamber of the primary cylinder, i.e. of the differential cylinder, and of connecting the high-pressure accumulator either to the ring chamber of the primary cylinder or alternatively to the chamber of the plunger cylinder. For an embodiment of the pressure transducer with a tandem cylinder as the primary cylinder and a plunger cylinder as the secondary cylinder, the high-pressure side of the working cylinder can be connected to a first ring chamber of the primary cylinder, while the high-pressure accumulator is connected either to the second ring chamber of the primary cylinder or to the chamber of the plunger cylinder.

For the refilling of the working cylinder, the first piston surface of the working cylinder can apply high pressure on a piston surface of the primary cylinder and the second piston surface of the working cylinder can simultaneously be connected to a piston surface of the primary cylinder or secondary cylinder of the pressure transducer. To ensure a lower pressure level at the outlet of the pressure transducer which is used for filling the volume-increasing cylinder chamber of the working cylinder, it is expedient if the piston surface of the primary cylinder acted on by high pressure is larger by area than the piston surface which displaces the required hydraulic medium for refilling the working cylinder.

To control the actuation of the working cylinder, in particular the load-induced retracting movement of its piston rod, the first piston surface of the working cylinder can be interconnected via a switch valve or a proportional valve to the primary cylinder of the pressure transducer to control or regulate the volume flow between both components. The piston movement of the working cylinder, in particular the retracting movement, is accordingly only possible when the integrated switch valve or proportional valve releases the volume flow. The flow quantity can additionally be controlled or regulated by use of a proportional valve in order thereby to influence the speed of the piston movement of the working cylinder.

Alternatively or supplementarily, the pressure transducer can be connected to the second piston surface of the working cylinder via a further switch valve or proportional valve. The piston movement, in particular the inward movement, of the working cylinder is only possible in this kind of interconnection when the switch valve or proportional valve releases the hydraulic connection. The use of the proportional valve additionally allows a control/regulation of the speed of the piston movement of the working cylinder.

In a particularly preferred embodiment of the invention, the pressure transducer can be connected to one or more further hydraulic consumers in order to supply them with hydraulic energy from the pressure accumulator via the pressure transducer. A common switch valve or proportional valve can be used for the connection of the one or more consumers or the consumers are connected to the pressure transducer via separate switch valves or proportional valves.

At least one precharging valve can be connected to the hydraulic tank in the hydraulic connection between the pressure transducer and the second piston surface of the working cylinder. Excess volume of the low-pressure volume flow provided by the pressure transducer for refilling the working cylinder can be output into the tank via the precharging valve. The precharging of the precharging valve is defined by a suitable pressure in order thereby to control the pressure level within the cylinder chamber of the working cylinder to be refilled.

Furthermore, at least one check valve can be integrated between the pressure transducer and the working cylinder to block a possible volume return from the working cylinder to the pressure transducer.

The pressure accumulator used can be designed as a gas accumulator, a piston accumulator, a membrane accumulator or also as a spring accumulator. The use of an external pressure accumulator is conceivable which is connected to the pressure transducer in a suitable manner. As an alternative, a direct integration of the pressure accumulator into the pressure transducer can be considered.

If external hydraulic consumers are supplied with hydraulic medium from the pressure accumulator, an undersupply of the pressure transducer with hydraulic fluid can occur. The pressure transducer can be connected to the hydraulic tank via at least one suction valve to compensate the led-off volume. The suction vale is designed, for example, as a check valve which only allows a volume flow from the tank in the direction of the pressure transducer.

In addition to the apparatus in accordance with the invention, the present invention also relates to a work machine, in particular to a construction machine or to a crane, having at least one working cylinder and an apparatus in accordance with the present invention. The same advantages and properties thus result for the work machine such as have already been explained with reference to the apparatus in accordance with the invention. A repetitive description is dispensed with for this reason.

In a particularly preferred embodiment of the work machine, the working cylinder can be actuated by an applied load. The working cylinder is, for example, a lifting cylinder for actuating a boom of the work machine. A load is present on the working cylinder due to the boom and triggers an unpressurized actuation of the working cylinder, as a rule an unpressurized retracting movement of the piston rod into the cylinder. The energy which thereby arises is reclaimed in that the energy which becomes free can be stored almost completely by means of the apparatus or its pressure accumulator. At the same time, the increasing cylinder volume of the working cylinder can be refilled with hydraulic medium from the pressure transducer.

It is also conceivable that one or more hydraulic consumers of the work machine can be supplied from the pressure accumulator of the apparatus or from an alternative hydraulic supply of the machine. Ideally, the primary supply of the external hydraulic suppliers is provided from the pressure accumulator and an emergency supply in a defect case of the apparatus or on a complete discharge of the pressure accumulator is ensured by an alternative source of energy.

BRIEF DESCRIPTION OF THE DRAWINGS

Further advantages and properties of the invention will be explained in the following with reference to a plurality of embodiments shown in the drawings.

There are shown.

DESCRIPTION OF THE PREFERRED EMBODIMENTS

Figure 1:
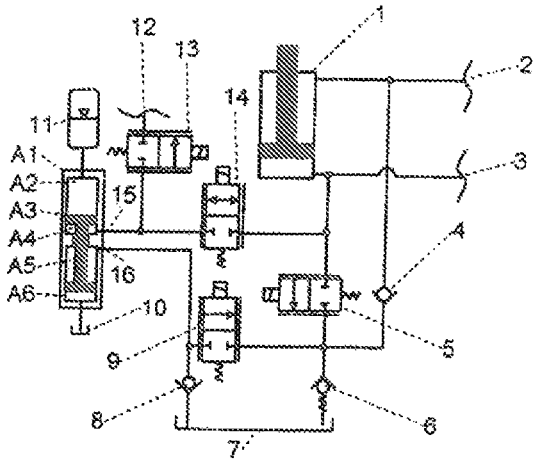
FIG. 1: a first embodiment of the apparatus in accordance with the invention.

An overview of the hydraulic circuit, which represents the invention described here, is shown in FIGS. 1 to 6. The circuit having the working cylinder 1 is a component of a work machine, for example of a crane or of a construction machine. The working cylinder or cylinders 1 serve as lifting cylinder(s) for carrying out a lifting movement of the boom system of the machine. When lowering the boom system, the load of the boom acts on the working cylinder 1 and allows an unpressurized retracting movement of the piston rod into the cylinder.

The circuit in accordance with the invention is characterized in that, when the working cylinder or cylinders 1 are retracted under a pressing load, the existing potential energy can be stored with the help of a hydraulic store 11 and a pressure transducer A, B, C. In addition, an energy-efficient refilling of the rod side of the working cylinder or cylinders 1 is made possible by the interconnections shown. The invention is additionally characterized by a parallel integration into a work machine, such as a crane or a construction machine, which also allows a problem-free function of all consumers on a failure of the storage apparatus 11.

The hydraulic transducer A, B, C in conjunction with the hydraulic accumulator 11 ensures that oil volume of the base side of the working cylinder or cylinders 1 can be taken up and that the potential energy contained therein can be stored with the help of the hydraulic accumulator 11. At the same time, the hydraulic pressure transducer A, B, C implements the filling of the rod sides of the working cylinder(s) 1 in that it displaces the oil volume necessary for this purpose. This oil displacement takes place at a low-pressure level since the base-side high-pressure level is compensated by the hydraulic accumulator 11. The speed of the lowering process can be set by a restriction valve 9 between the hydraulic pressure transducer A, B, C and the rod side of the working cylinders 1. The filling of the rod sides of the working cylinders 1 is characterized as "energy-efficient" since the restriction point 9 only has to generate comparatively small pressure losses to set the lowering speed.

The described circuit can be operated with three different pressure transducers A, B and C in two respectively different interconnections. They only differ by the arrangement of the hydraulic accumulator 11 and by the design of the pressure transducer A, B, C. The following applies to all interconnections:

If the storage process is to be started, a force must be applied to the working cylinder 1 which results in the retraction of the working cylinder 1. A pressure is hereby built up on the base side of the working cylinder 1 which defines the potentially available energy. This potential energy should be taken up by a hydraulic accumulator 11. A connection between the base side and the connection 15 of the pressure transducer A, B or C is provided by the hydraulic valve 14 designed as a switch valve or as a proportional valve. A pressure is adopted at the outlet 16 on the basis of the equilibrium of forces within the pressure transducer A, B or C. No retracting movement of the working cylinder 1 can take place up to the actuation of the hydraulic valve 9. The escape of an oil volume from the pressure transducer A, B or C is made possible by a proportional control of the hydraulic valve 9 and the speed of the retracting movement of the working cylinder 1 is simultaneously determined. It made possible by the hydraulic valve 9 for this volume flow to move via the check valve 4 into the rod-side chamber of the working cylinder 1. An exiting volume flow is generated at the outlet 16 on the take-up of volume flow at the connection 15 due to the configuration of the pressure transducer A, B or C. The excess volume flow which is not needed for filling the rod-side chamber of the working cylinder 1 is led by the precharging valve 6 to the tank 7 with an adjustable precharging pressure at the precharging valve 6.

If the storage process is stopped, the normal control can be initiated for retracting the working cylinder 1. The hydraulic valves 9 and 14 are closed for this purpose. The volume flow from the base-side chamber of the working cylinder 1 is led via the check valve 4 into the rod-side chamber of the working cylinder 1 by a proportional control of the hydraulic valve 5. The excess oil quantity from the base side of the working cylinder 1 is led into the tank 7 via the precharging valve 6 with an adjustable precharging pressure. The normal control of the working cylinder 1 for lifting and lowering without a storage process takes place via the connections 2 and 3. An outflow of the supplied volume flow at connection 2 to the tank is prevented by the check valve 4.

The hydraulic valves 9 and 14 are kept closed for reusing the hydraulic energy in the hydraulic accumulator 11. Pressurized volume flow which escapes from the connection 15 of the pressure transducer can be taken off at the connection 12 by a switching or proportional actuation of the hydraulic valve 13. A volume flow shortage arises at the low-pressure connection 16 by removal of volume flow from the pressure transducer A, B or C at the connection 15. The short volume flow is supplied via the suction valve 8.

All kinds of hydraulic accumulators can be used as the hydraulic accumulator 11. Embodiments as gas accumulators, piston accumulators, membrane accumulators or spring accumulators are conceivable. The direct integration of the accumulator 11 in the pressure transducers A, B, C is furthermore possible. The invention is not restricted to one kind or one type of the energy storage medium. Nitrogen or nitrogen mixtures are typically used in gas accumulators and piston accumulators. In addition, a use of a combination of different pressure transducers and also a use of different accumulators in different combinations is possible. The valves shown can be used as single 2/2 way valves or also as a combination on a valve rod. In this respect, a proportional or switching control is likewise possible.

In accordance with the embodiment of FIG. 1, the pressure transducer A comprises two differential cylinders which are coupled to one another via their piston rods. The primary cylinder has the piston A3, the piston chamber A2 and the ring chamber A4. The secondary cylinder comprises the piston chamber A6 and the ring chamber A5. On actuation of the hydraulic valve 14, a connection is created between the base side of the working cylinder 1 and of the upper ring chamber A4 of the pressure transducer A1 via the connection 15 and the base-side pressure of the working cylinder 1 is applied to the ring surface of the piston A3. The upper piston chamber A2 of the pressure transducer A is connected to a hydraulic accumulator 11. The lower piston chamber A6 of the pressure transducer A is connected to the tank 10 or to the environment.

The lower ring chamber A5 of the pressure transducer A1 is first closed by a hydraulic valve 9 via the low-pressure outlet 16. A pressure is adopted in the lower ring chamber A5 on the basis of the equilibrium of forces at the piston A3 of the pressure transducer A. The pressure adopted is reduced in the lower ring chamber A5 in contrast to the base-side pressure of the working cylinder 1 by the oppositely acting forces of the pressures in the upper piston chamber A2 and the upper ring chamber A4. No retracting movement of the working cylinder 1 can take place up to the actuation of the hydraulic valve 9 at the outlet 16. An escape of the oil volume out of the lower ring chamber A4 via the outlet 16 is made possible by a proportional control of the hydraulic valve 9. This volume flow moves through the hydraulic valve 9 via the check valve 4 into the rod-side chamber of the working cylinder 1. A proportional volume flow is displaced from the lower ring chamber A5 on the take-up of volume flow into the upper ring chamber A2 by the configuration of the piston A3. The excess volume flow which is not needed for filling the rod-side chamber of the working cylinder 1 is led by the precharging valve 6 to the tank 7 with an adjustable precharging pressure at the precharging valve 6.

Figure 2:
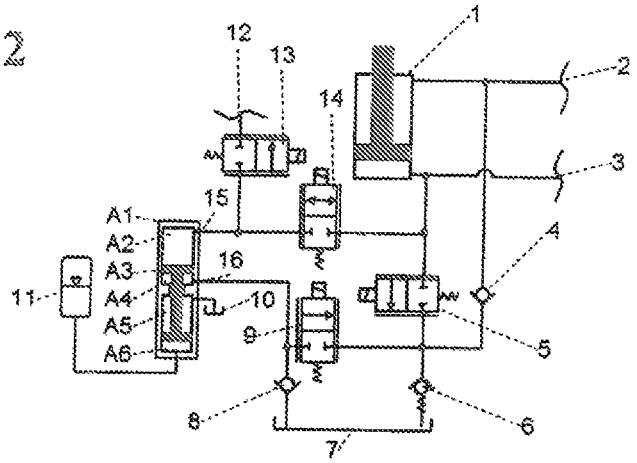
FIG. 2: a second embodiment of the apparatus in accordance with the invention.

The embodiment of FIG. 2 likewise makes use of the pressure transducer A in accordance with FIG. 1, but the interconnection to the working cylinder 1 and to the store 11 takes place in a different manner from this. On actuation of the hydraulic valve 14, a connection is created between the base side of the working cylinder 1 and of the upper piston chamber A2 of the pressure transducer A via the connection 15 and the base-side pressure of the working cylinder 1 is applied to the upper piston surface of the piston A3. The lower piston chamber A6 of the pressure transducer A is connected to a hydraulic accumulator 11. The lower ring chamber A5 of the pressure transducer A is connected to the tank 10 or to the environment. The upper ring chamber A4 of the pressure transducer A is first closed by a hydraulic valve 9 via the outlet 16. A pressure is adopted in the upper ring chamber A4 on the basis of the equilibrium of forces at the piston A3 of the pressure transducer A. The pressure adopted is reduced in the upper ring chamber A4 in contrast to the base-side pressure of the working cylinder 1 by the oppositely acting forces of the pressures in the upper piston chamber A2 and the lower ring chamber A5. No retracting movement of the working cylinder 1 can take place up to the actuation of the hydraulic valve 9 at connection 16. An escape of the oil volume out of the upper ring chamber A4 via connection 16 is made possible by a proportional control of the hydraulic valve 9. This volume flow moves through the hydraulic valve 9 via the check valve 4 into the rod-side chamber of the cylinder 1. A proportional volume flow is displaced from the upper ring chamber A4 on the take-up of volume flow into the upper ring chamber A2 by the configuration of the piston A3. The excess volume flow which is not needed for filling the rod-side chamber of the working cylinder 1 is led by the precharging valve 6 to the tank 7 with an adjustable precharging pressure at the precharging valve 6.

Figure 3:
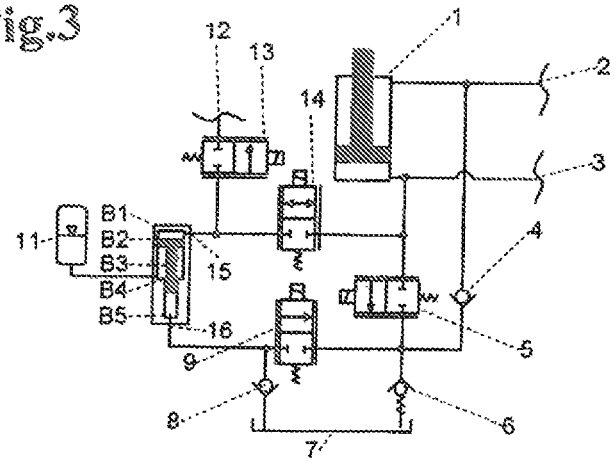
FIG. 3: a third embodiment of the apparatus in accordance with the invention.

FIG. 3 shows an embodiment with another pressure transducer B. It comprises a differential cylinder with the piston chamber B2, the piston B3 and the ring chamber B4. The secondary cylinder is a plunger cylinder having the rod chamber B5. On actuation of the hydraulic valve 14, a connection is created between the base side of the working cylinder 1 and the piston chamber B2 of the pressure transducer B via the connection 15 and the base-side pressure of the working cylinder 1 is applied to the piston surface of the piston B3. The ring chamber B4 of the pressure transducer B is connected to a hydraulic accumulator 11. The rod chamber B5 of the pressure transducer B is first connected via connection 16 to a hydraulic valve 9. A pressure is adopted in the rod chamber B5 on the basis of the equilibrium of forces at the piston B3 of the pressure transducer B. The pressure adopted is reduced in the rod chamber B5 in contrast to the base-side pressure of the working cylinder 1 by the oppositely acting forces of the pressures in the piston chamber B2 and the ring chamber B4. No retracting movement of the working cylinder 1 can take place up to the actuation of the hydraulic valve 9 at the connection 16. An escape of the oil volume out of the rod chamber B5 via the connection 16 is made possible by a proportional control of the hydraulic valve 9. This volume flow moves through the hydraulic valve 9 via the check valve 4 into the rod-side chamber of the working cylinder 1. A proportional volume flow is displaced from the rod chamber B5 on the take-up of volume flow into the piston chamber B2 by the configuration of the piston B3. The excess volume flow which is not needed for filling the rod-side chamber of the working cylinder 1 is led by the precharging valve 6 to the tank 7 with an adjustable precharging pressure at the precharging valve 6.

Figure 4:
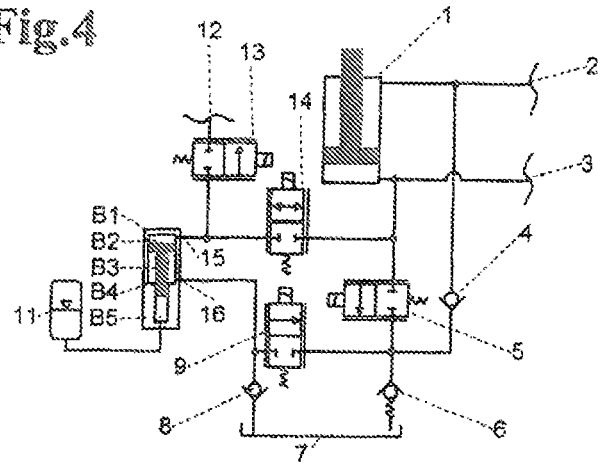
FIG. 4: a fourth embodiment of the apparatus in accordance with the invention.

The embodiment of FIG. 4 likewise uses the pressure transducer B in accordance with FIG. 3, but uses a modified interconnection. On actuation of the hydraulic valve 14, a connection is created between the base side of the working cylinder 1 and the piston chamber B2 of the pressure transducer B via the connection 15 and the base-side pressure of the working cylinder 1 is applied to the piston surface of the piston B3. The rod chamber B5 of the pressure transducer B is connected to a hydraulic accumulator 11. The ring chamber B4 of the pressure transducer B is first connected via connection 16 to a hydraulic valve 9. A pressure is adopted in the ring chamber B4 on the basis of the equilibrium of forces at the piston B3 of the pressure transducer B. The pressure adopted is reduced in the ring chamber B4 in contrast to the base-side pressure of the working cylinder 1 by the oppositely acting forces of the pressures in the piston chamber B2 and the rod chamber B5. No retracting movement of the working cylinder 1 can take place up to the actuation of the hydraulic valve 9 at the connection 16. An escape of the oil volume out of the ring chamber B4 via connection 16 is made possible by a proportional control of the hydraulic valve 9. This volume flow moves through the hydraulic valve 9 via the check valve 4 into the rod-side chamber of the working cylinder 1. A proportional volume flow is displaced from the ring chamber B4 on the take-up of volume flow into the piston chamber B2 by the configuration of the piston B3. The excess volume flow which is not needed for filling the rod-side chamber of the working cylinder 1 is led by the precharging valve 6 to the tank 7 with an adjustable precharging pressure at the precharging valve 6.

Figure 5:
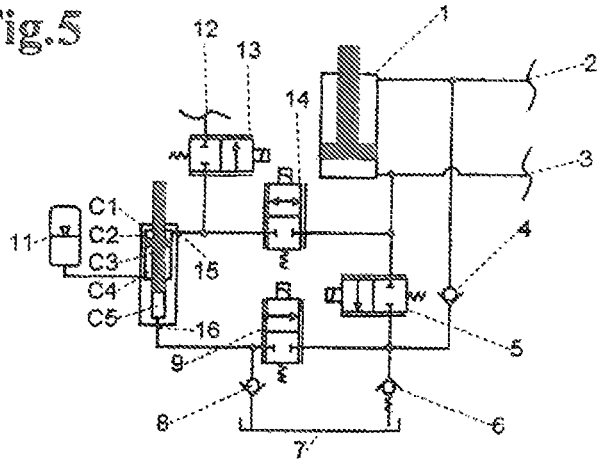
FIG. 5: a fifth embodiment of the apparatus in accordance with the invention.

The embodiment of FIG. 5 uses the pressure transducer C which comprises a tandem cylinder with the upper ring chamber C2, the piston C3 and the lower ring chamber C4. The tandem cylinder is coupled via its piston rod to the plunger cylinder which comprises the rod chamber C5. On actuation of the hydraulic valve 14, a connection is created between the base side of the working cylinder 1 and the upper ring chamber C2 of the pressure transducer C via connection 15 and the base-side pressure of the working cylinder 1 is applied to the upper ring surface C2 of the piston C3. The lower ring chamber C4 of the pressure transducer C is connected to a hydraulic accumulator 11. The rod chamber C5 of the pressure transducer C is first connected via connection 16 to a hydraulic valve 9. A pressure is adopted in the rod chamber C5 on the basis of the equilibrium of forces at the piston C3 of the pressure transducer C. The pressure adopted is reduced in the rod chamber C5 in contrast to the base-side pressure of the working cylinder 1 by the oppositely acting forces of the pressures in the upper ring chamber C2 and the lower ring chamber C4. No retracting movement of the working cylinder 1 can take place up to the actuation of the hydraulic valve 9 at connection 16. An escape of the oil volume out of the rod chamber C5 via the connection 16 is made possible by a proportional control of the hydraulic valve 9. This volume flow moves through the hydraulic valve 9 via the check valve 4 into the rod-side chamber of the working cylinder 1. A proportional volume flow is displaced from the rod chamber C5 on the take-up of volume flow into the upper ring chamber C2 by the configuration of the piston C3. The excess volume flow which is not needed for filling the rod-side chamber of the working cylinder 1 is led by the precharging valve 6 to the tank 7 with an adjustable precharging pressure at the precharging valve 6.

Figure 6:
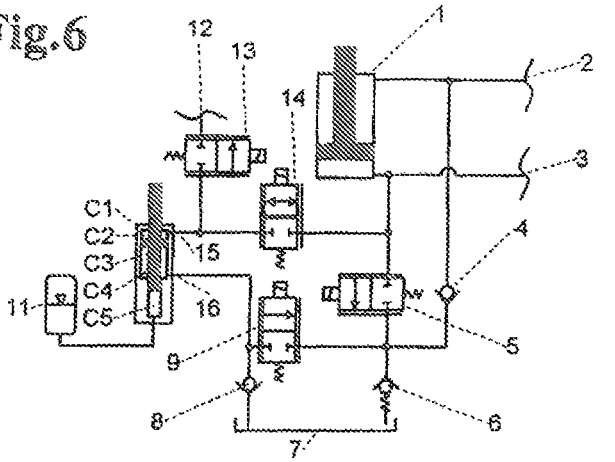
FIG. 6: a sixth embodiment of the apparatus in accordance with the invention.

The last embodiment of FIG. 6, in contrast to the embodiment in accordance with FIG. 5, only provides a modified interconnection of the pressure transducer C. On actuation of the hydraulic valve 14, a connection is created between the base side of the working cylinder 1 and the upper ring chamber C2 of the pressure transducer C via connection 15 and the base-side pressure of the working cylinder 1 is applied to the upper ring surface C2 of the piston C3. The rod chamber C5 of the pressure transducer C is connected to a hydraulic accumulator 11. The lower rod chamber C4 of the pressure transducer C1 is first connected via connection 16 to a hydraulic valve 9. A pressure is adopted in the lower ring chamber C4 on the basis of the equilibrium of forces at the piston C3 of the pressure transducer C1. The pressure adopted is reduced in the lower ring chamber C4 in contrast to the base-side pressure of the working cylinder 1 by the oppositely acting forces of the pressures in the upper ring chamber C2 and the rod chamber C5. No retracting movement of the working cylinder 1 can take place up to the actuation of the hydraulic valve 9 at the connection 16. An escape of the oil volume out of the lower ring chamber C4 via connection 16 is made possible by a proportional control of the hydraulic valve 9. This volume flow moves through the hydraulic valve 9 via the check valve 4 into the rod-side chamber of the working cylinder 1. A proportional volume flow is displaced from the lower ring chamber C4 on the take-up of volume flow into the upper ring chamber C2 by the configuration of the piston C3. The excess volume flow which is not needed for filling the rod-side chamber of the working cylinder 1 is led by the precharging valve 6 to the tank 7 with an adjustable precharging pressure at the precharging valve 6.

The invention is further characterized in that the system for storing the hydraulic energy is designed such that the system is not necessary for the standard operation of the machine. The machine can be operated further as normal on a failure of the storage system.

The invention claimed is:

1. A hydraulic circuit for operating a work machine, comprising a double acting working cylinder (1) comprising a piston rod and head, a hydraulic valve (14) coupled to a base side of the double acting working cylinder (1), a hydraulic valve and connection (12, 13) coupled to the hydraulic valve (14) on a side opposite the working cylinder (1), a pressure transducer (A) coupled (15) to the hydraulic valve and connection (12, 13) and the hydraulic valve (14) on the side opposite the working cylinder (1), said pressure transducer (A) comprising two separate cylinders coupled together through a double-headed piston rod (A3), an accumulator (11) coupled to one of these separate transducer cylinders, a restriction valve (9) coupled to a low pressure outlet (16) from the transducer (A) and, on an opposite side, to a rod side of the double acting cylinder (1), a further hydraulic valve (5) coupled between the restriction valve (9) and the rod side of the double acting cylinder (1), and between the hydraulic valve (14) and the base side of the double acting cylinder (1), and a tank (7) coupled to the further hydraulic valve (5) between the restriction valve (9) and the rod side of the double acting cylinder (1) and, on an opposite side, between the low pressure outlet (16) and the restriction valve (9).

2. The hydraulic circuit of claim 1, wherein the accumulator (11) is coupled to a piston chamber (A2) of one (A1) of the cylinders, said hydraulic valve and connection (12, 13) are coupled (15) to a ring chamber (A4) of the same cylinder (A1), said low pressure outlet (16) is located on a ring chamber (A5) of the other cylinder, and a second tank (10) is coupled to a piston chamber (A6) of the other cylinder.

3. The hydraulic circuit of claim 2, additionally comprising a check valve (4) positioned between the working cylinder (1) and the restriction and hydraulic valves (9, 5), a pre-charging valve (6) positioned between the first tank (7) and the check valve (4) and the restriction and hydraulic valves (9, 5), and a suction valve (8) positioned between the first tank (7) and said restriction valve (9) and said low pressure outlet (16).

4. The hydraulic circuit of claim 1, wherein said hydraulic valve and connection (12, 13) are coupled (15) to a piston chamber (A2) of one (A1) of the cylinders, said low pressure outlet (16) is located on a ring chamber (A4) of the same cylinder (A1), the accumulator (11) is coupled to a piston chamber (A6) of the other cylinder, and a second tank (10) is coupled to a ring chamber (A5) of the other cylinder.

5. The hydraulic circuit of claim 4, additionally comprising a check valve (4) positioned between the working cylinder (1) and the restriction and hydraulic valves (9, 5), a pre-charging valve (6) positioned between the first tank (7) and the check valve (4) and the restriction and hydraulic valves (9, 5), and a suction valve (8) positioned between the first tank (7) and said restriction valve (9) and said low pressure outlet (16).

6. A hydraulic circuit for operating a work machine, comprising a double acting working cylinder (1) comprising a piston rod and head, a hydraulic valve (14) coupled to a base side of the double acting working cylinder (1), a hydraulic valve and connection (12, 13) coupled to the hydraulic valve (14) on a side opposite the working cylinder (1), a pressure transducer (B) coupled (15) to the hydraulic valve and connection (12, 13) and the hydraulic valve (14) on the side opposite the working cylinder (1), said pressure transducer (B) comprising a differential cylinder having a piston chamber (B2), a piston (B3) mounted therein, a ring chamber (B4), and a secondary cylinder comprising a rod chamber (B5), an accumulator (11) coupled to one of these chambers (B2, B5), a restriction valve (9) coupled to a low pressure outlet (16) from the transducer (B) and, on an opposite side, to a rod side of the double acting cylinder (1), a further hydraulic valve (5) coupled between the restriction valve (9) and the rod side of the double acting cylinder (1), and between the hydraulic valve (14) and the base side of the double acting cylinder (1), and a tank (7) coupled to the further hydraulic valve (5) between the restriction valve (9) and the rod side of the double acting cylinder (1) and, on an opposite side, between the low pressure outlet (16) and the restriction valve (9).

7. The hydraulic circuit of claim 6, wherein the accumulator (11) is coupled to the ring chamber (B4) of the differential cylinder, said hydraulic valve and connection (12, 13) are coupled (15) to the piston chamber (B2) of the differential cylinder, and said low pressure outlet (16) is located on the rod chamber (B5) of the secondary cylinder.

8. The hydraulic circuit of claim 7, additionally comprising a check valve (4) positioned between the working cylinder (1) and the restriction and hydraulic valves (9, 5), a pre-charging valve (6) positioned between the tank (7) and the check valve (4) and the restriction and hydraulic valves (9, 5), and a suction valve (8) positioned between the tank (7) and said restriction valve (9) and said low pressure outlet (16).

9. The hydraulic circuit of claim 6, wherein the accumulator (11) is coupled to the rod chamber (B5) of the secondary cylinder, said hydraulic valve and connection (12, 13) are coupled (15) to the piston chamber (B2) of the differential cylinder, and said low pressure outlet (16) is located on the rod chamber (B4) of the differential cylinder.

10. The hydraulic circuit of claim 9, additionally comprising a check valve (4) positioned between the working cylinder (1) and the restriction and hydraulic valves (9, 5), a pre-charging valve (6) positioned between the tank (7) and the check valve (4) and the restriction and hydraulic valves (9, 5), and a suction valve (8) positioned between the tank (7) and said restriction valve (9) and said low pressure outlet (16).

11. A hydraulic circuit for operating a work machine, comprising a double acting working cylinder (1) comprising a piston rod and head, a hydraulic valve (14) coupled to a base side of the double acting working cylinder (1), a hydraulic valve and connection (12, 13) coupled to the hydraulic valve (14) on a side opposite the working cylinder (1), a pressure transducer (C) coupled (15) to the hydraulic valve and connection (12, 13) and the hydraulic valve (14) on the side opposite the working cylinder (1), said pressure transducer (C) comprising a tandem cylinder having an upper ring chamber (C2), a lower ring chamber (C4), a piston rod (C3) disposed in the upper and lower ring chambers (C2, C4), and a rod chamber (C5), an accumulator (11) coupled to one of these chambers (C4, C5), a restriction valve (9) coupled to a low pressure outlet (16) from the transducer (C) and, on an opposite side, to a rod side of the double acting cylinder (1), a further hydraulic valve (5) coupled between the restriction valve (9) and the rod side of the double acting cylinder (1), and between the hydraulic valve (14) and the base side of the double acting cylinder (1), and a tank (7) coupled to the further hydraulic valve (5) between the restriction valve (9) and the rod side of the double acting cylinder (1) and, on an opposite side, between the low pressure outlet (16) and the restriction valve (9).

12. The hydraulic circuit of claim 11, wherein the accumulator (11) is coupled to the lower ring chamber (C4) of the tandem cylinder, said hydraulic valve and connection (12, 13) are coupled (15) to the upper ring chamber (C2) of the tandem cylinder, and said low pressure outlet (16) is located on the rod chamber (C5).

13. The hydraulic circuit of claim 12, additionally comprising a check valve (4) positioned between the working cylinder (1) and the restriction and hydraulic valves (9, 5), a pre-charging valve (6) positioned between the tank (7) and the check valve (4) and the restriction and hydraulic valves (9, 5), and a suction valve (8) positioned between the tank (7) and said restriction valve (9) and said low pressure outlet (16).

14. The hydraulic circuit of claim 11, wherein the accumulator (11) is coupled to the rod chamber (C5), said hydraulic valve and connection (12, 13) are coupled (15) to the upper ring chamber (C2) of the tandem cylinder, and said low pressure outlet (16) is located on the lower ring chamber (C4) of the tandem cylinder.

15. The hydraulic circuit of claim 14, additionally comprising a check valve (4) positioned between the working cylinder (1) and the restriction and hydraulic valves (9, 5), a pre-charging valve (6) positioned between the tank (7) and the check valve (4) and the restriction and hydraulic valves (9, 5), and a suction valve (8) positioned between the tank (7) and said restriction valve (9) and said low pressure outlet (16).

* * * * *